US005476569A

United States Patent [19]

Harada

[11] Patent Number: 5,476,569

[45] Date of Patent: Dec. 19, 1995

[54] BINDING TOOL OF FRICTION WELDING TYPE FOR A THERMOPLASTIC STRAP

[75] Inventor: Hiroshi Harada, Kudamatsu, Japan

[73] Assignees: Sekisui Jushi Kabushiki Kaisha, Osaka; Kohan Kogyo Kabushiki Kaisha, Kudamatsu, both of Japan

[21] Appl. No.: 133,333

[22] Filed: Oct. 8, 1993

[30] Foreign Application Priority Data

Oct. 12, 1992 [JP] Japan ..... 4-077540 U
Feb. 26, 1993 [JP] Japan ..... 5-063487

[51] Int. Cl.[6] ..... B29C 65/06

[52] U.S. Cl. ..... 156/502; 156/73.5; 156/580; 100/33 PB

[58] Field of Search ..... 156/73.5, 502, 156/580, 580.1, 580.2, 581, 515; 100/33 PB, 29, 32, 33 R; 264/68

[56] References Cited

U.S. PATENT DOCUMENTS

| | | | |
|---|---|---|---|
| 3,442,734 | 5/1969 | Ericsson | 156/73.5 |
| 3,554,845 | 1/1971 | Billett et al. | 156/73.5 X |
| 3,654,033 | 4/1972 | Angarola et al. | 156/494 |
| 4,050,372 | 9/1977 | Kobiella | 156/73.5 X |
| 4,305,774 | 12/1981 | Wedeking et al. | 156/494 |
| 4,313,779 | 2/1982 | Nix | 156/361 |
| 4,820,363 | 4/1989 | Fischer | 156/73.5 X |
| 4,952,271 | 8/1990 | Cheung et al. | 156/502 |
| 5,141,591 | 8/1992 | Boek et al. | 156/73.5 X |
| 5,238,521 | 8/1993 | Cheung et al. | 156/73.5 X |
| 5,306,383 | 4/1994 | Kobiella | 156/73.5 X |

FOREIGN PATENT DOCUMENTS

| | | |
|---|---|---|
| 2100306 | 1/1971 | Germany . |
| 2701126 | 1/1977 | Germany . |
| 381910 | 4/1980 | Germany . |
| 17-19238 | 9/1942 | Japan . |
| 2-10006 | 3/1990 | Japan . |
| 5-132020 | 5/1993 | Japan . |
| 1550101 | 11/1977 | United Kingdom . |

*Primary Examiner*—James Engel
*Assistant Examiner*—J. Sells
*Attorney, Agent, or Firm*—Armstrong, Westerman, Hattori, McLeland & Naughton

[57] ABSTRACT

A tool for frictionally welding and binding art overlapped part of thermoplastic strap wound about an object by an vibrator. In order to horizontally vibrate the vibrator, an upper part of flange of the vibrator is abutted to a lower part of needle holder, a lower part of the flange is engaged with an elastic member, and the vibrator is lowered by direct pressure of needle holder, and lifted by the elastic member. Thus, by the leading end of vibrator that is horizontally vibrated, an upper strap is vibrated in the direction of width against a lower strap, while applying a pressure to the overlapped strap part, and the overlapped strap part is frictionally welded. In addition, a rutting blade is elastically moved in the vertical direction by the elastic member, and applied with an appropriate pressure of such level that the upper strap cannot be cut only with the pressure, so that the succeeding excess part of upper strap is cut apart by the cutting blade due to the vibration, when the upper strap of overlapped strap part is vibrated.

18 Claims, 6 Drawing Sheets

BINDING TOOL OF FRICTION WELDING TYPE FOR A THERMOPLASTIC STRAP

BACKGROUND OF THE INVENTION

1. Field of the Invention

The present invention relates to an improvement of binding tool of friction welding type for a thermoplastic strap, wherein the thermoplastic strap wound and overlapped about an article is tightened, an overlapped part of strap tightened is frictionally welded by vibrating an upper strap, while applying pressure to the overlapped strap part by an vibrator, and the succeeding excess part of upper strap in the overlapped strap part that is frictionally welded is cut off.

2. Description of the Prior Art

Conventionally, binding of articles by using a thermoplastic strap has been widely performed. Particularly in these days, the thermoplastic straps have been significantly increased in tensile strength, and widely applied even for heavy articles. In such tendency, the technology for welding an overlapped part of thermoplastic strap has been significantly advanced, and a lot of binding machines and tools of friction welding type are found. Specifically, a small and heavy-duty binding tool of friction welding type that needs no bulky facility and structure, and is carried at any time to an appropriate place for binding operation is on demand.

Key requirements for such binding tool of friction welding type are that pressure and vibration by a vibrator should be efficiently and faultlessly transmitted to the overlapped strap part, and the structure should be simplified to provide as small size and as light weight as possible. However, conventional tools are not always satisfactory. In other words, the efficiency of pressurization and vibration has been unachieved, when compactness and weight reduction are importantly addressed to, and a slight bulkiness has been unavoidable, when the efficiency of pressurization and vibration is put into focus. For example, such a binding tool as described in Japanese Patent KOKOKU No. 42-19238 and No. 2-10006 is complicated in structure, and has a problem even in terms of the efficiency of pressurization and vibration, because the overlapped strap part is vibrated arcuately.

In addition, although a cutting device shown in Japanese Patent KOKOKU No. 2-10006 is relatively convenient, because it is adapted to utilize a high-speed vibration in the direction of width for friction welding of the overlapped strap part, and cut the succeeding excess part of upper strap of the overlapped part only by slightly applying pressure with a cutting blade, increase of the manufacturing cost has been unavoidable. Moreover, since the overlapped strap part is vibrated arcuately, the cutting blade is also arranged so as to be moved along an arcuate track, and it has not always been satisfiable even in terms of cutting efficiency.

SUMMARY OF THE INVENTION

It is an object of the invention to provide a binding tool of friction welding type for a thermoplastic strap capable of solving the conventional problems by enabling a horizontal or more horizontal vibration of vibrator, thereby efficiently transmitting pressure and vibration of the vibrator, and allowing reduction in size and weight by simplifying the structure.

It is another object of the invention to provide a binding tool of friction welding type for a thermoplastic strap having a very simple mechanism of cutting device for a succeeding excess part of upper strap in an overlapped strap part, and providing a superior cutting efficiency.

In order to achieve the above objects, the invention is presented in the following arrangement.

In an embodiment of a binding tool of friction welding type for a thermoplastic strap according to the invention, a binding tool of friction welding type for a thermoplastic strap that tightens the thermoplastic strap wound and overlapped about an article, and frictionally welds it by vibrating an upper strap, while applying pressure to an overlapped part of the strap tightened, comprises a needle holder connected to a piston of a pressure cylinder by a joint pin, an elastic member held by the needle holder and an vibrator having a flange in an upper part thereof and vibrated by an vibration mechanism, wherein an upper part of the vibrator flange is abutted to a lower part of the needle holder, and a lower part of the vibrator flange is engaged with the elastic member in order to provide horizontal vibration of the vibrator, so that the vibrator is directly pressed and lowered by the needle holder with a succeeding lifting step achieved by the elastic member, thus, the friction welding is achieved by applying pressure to the overlapped strap part, while vibrating the tipper strap in the direction of width against a lower strap by a leading end of the vibrator in horizontal vibration.

In the above arrangement, the vibrator is not directly connected to the piston and is lowered and pressed by direct pressure of the needle holder that is connected to the piston and a succeeding lifting step is achieved by the elastic member. It is because, the efficiency of pressurization and vibration would be reduced, if the vibrator were directly connected to the piston as in the prior art, since the leading end of vibrator is moved, to be strict, in so-called arcuate motion about a center in the connection part, and pressure and vibration applied to the overlapped strap part are different between the central part and both ends of strap width. Accordingly, in the invention, the efficiency of pressurization and vibration is increased by horizontally moving the vibrator in parallel with the overlapped strap part by avoiding direct connection of the vibrator with the piston. Additionally, the vibrator is lifted by a very simple mechanism through the use of elastic member.

Incidentally, the vibrator may be pressed through a roller by employing the roller between a concave part in the upper part of vibrator flange and the lower part of needle holder for smooth horizontal vibration, and transmission of vibration of the vibrator to the overlapped strap part may be assured by forming projections in the leading end of vibrator and strap pressure support part, respectively, for preventing slippage.

Moreover, a cutting blade may be attached to the elastic member, and an appropriate pressure of such level that the tipper strap cannot be cut only by the pressure may be applied to the cutting blade by elastically lifting and lowering the cutting blade by means of vertical movement of the elastic member. In such case, in combination with the horizontal vibration of overlapped strap part by the vibrator, the succeeding excess part of upper strap can be efficiently cut off.

In other words, although the cutting blade is abutted to the succeeding excess part of the overlapped strap's upper part as the needle holder holding the elastic member is lowered, because a pressure of the needle holder is transmitted to the cutting blade through the elastic member, the cutting blade is effected to the upper strap with the pressure insufficient for cutting it off by itself. When the upper strap of overlapped strap part is finely vibrated in the direction of width at a high speed by the vibrator under such pressure, because the cutting blade provides a significant effect, the upper strap can be serially cut without moving the cutting blade, and completely cut off before friction welding of the overlapped strap part is finally achieved. Then, when the cutting blade is abutted to the lower strap of overlapped strap part, as the lower strap is fixed, it cannot be cut off. After the cutting is completed, and the needle holder is lifted by the piston, the cutting blade is lifted together with the elastic member. Here, as already described, the vibrator is lifted simultaneously with the elastic member. By attaching the cutting blade to the elastic member in such manner, the succeeding excess part of upper strap can be cut off, and the vibrator lifted efficiently by a very simple mechanism.

As the elastic member, a spring rod is preferable. Also, although the shape of cutting blade may be of a linear flat blade, a saw-tooth blade is preferred for a higher cutting efficiency.

In another embodiment of a binding tool of friction welding type for a thermoplastic strap according to the invention, a binding tool comprises a pressure cylinder having a hollow piston, and a pendulum-type vibrator vertically moved by the pressure cylinder, and vibrated in its lower part by an vibration mechanism, wherein a distance between a support axis and leading end of the vibrator is extended to the maximum possible, by housing an arm of the vibrator in the hollow of piston and pivoting an upper part of the vibrator at an upper part of piston by the support shaft, so that an upper strap is vibrated in the direction of width to a lower strap, while applying pressure to an overlapped strap part by the leading end of vibrator that is moved along an arcuate vibration track as horizontal as possible about a center in a support shaft for friction welding.

In the above embodiment, because the piston is hollow, the vibrator arm is placed through the hollow, and the upper part of the vibrator is pivoted by the support shaft at the upper part of piston, in comparison with those pivoted at the lower part of piston as conventional ones, the vibrator of the invention is arranged to be of a pendulum-type having a long arm swinging about a center in the support shaft. Therefore, although the vibrator is vibrated so as to be moved along an arcuate vibration track centered about the support shaft, since the vibration diameter is relatively large, the leading end of vibrator is vibrated along an arcuate track that is closer to a straight line, and the upper strap of overlapped strap part can be efficiently vibrated. In addition, by housing the vibrator arm in the hollow of piston, since the length of arm can be absorbed in the hollow of piston, even when it is elongated, reduction of size can be achieved.

The size reduction may be achieved by projecting an upper part of the piston above a cylinder cover of the pressure cylinder, and pivoting the support axis in the upper part of vibrator by the support shaft in the upper part of piston that is projected.

Additionally, the vibration of vibrator is surely transmitted to the overlapped strap part by means of forming projections for preventing slippage in the leading end of vibrator and strap pressure support part placed against the leading end of vibrator, respectively, and further forming a projected surface of the leading end of vibrator in a moderately convexed arcuate surface centered about the support shaft to the vibrating direction of vibrator, while forming a projected surface of the strap pressure support part, corresponding to the projected surface of leading end of the vibrator, in a concave arcuate surface along the vibrating direction with a diameter being a distance to the support shaft including a thickness of the overlapped strap part of thermoplastic strap that is clamped between them.

Moreover, by holding the elastic member to a bottom cover of the piston, and elastically moving a cutting blade in a vertical movement by the elastic member, an appropriate pressure of such level as the upper strap cannot be cut only by the pressure may be applied to the cutting blade. In such case, in combination with the approximately horizontal vibration of upper strap of the overlapped strap part by the vibrator, a succeeding excess part of the upper strap can be efficiently cut off.

Incidentally, although the elastic member may be a plate spring, helical spring or the like, a spring rod is preferably employed.

In a binding tool of friction welding type for a thermoplastic strap according to the invention, an vibrating mechanism for vibrating an vibrator may be constructed so as to have a motor shaft housed in a hollow that is formed in the vibrator, an eccentric shaft, a bearing and a hollow roller, whereby the eccentric shaft pivoted to the motor shaft is rotated by rotating an vibrating motor, and the vibrator is vibrated at a high speed through the bearing and hollow roller by the rotation of eccentric shaft. In such arrangement, the vibrator is assured for high-speed vibration with a compact and simple structure.

The above and further objects, features and advantages of the invention will more fully appear from the following description with reference to the accompanying drawings. It is to be expressly understood, however, that the drawings are for purpose of illustration only, and are not intended as a definition of the limits of the invention.

DETAILED DESCRIPTION OF THE PREFERRED EMBODIMENTS

EXAMPLE 1

Figure 1:
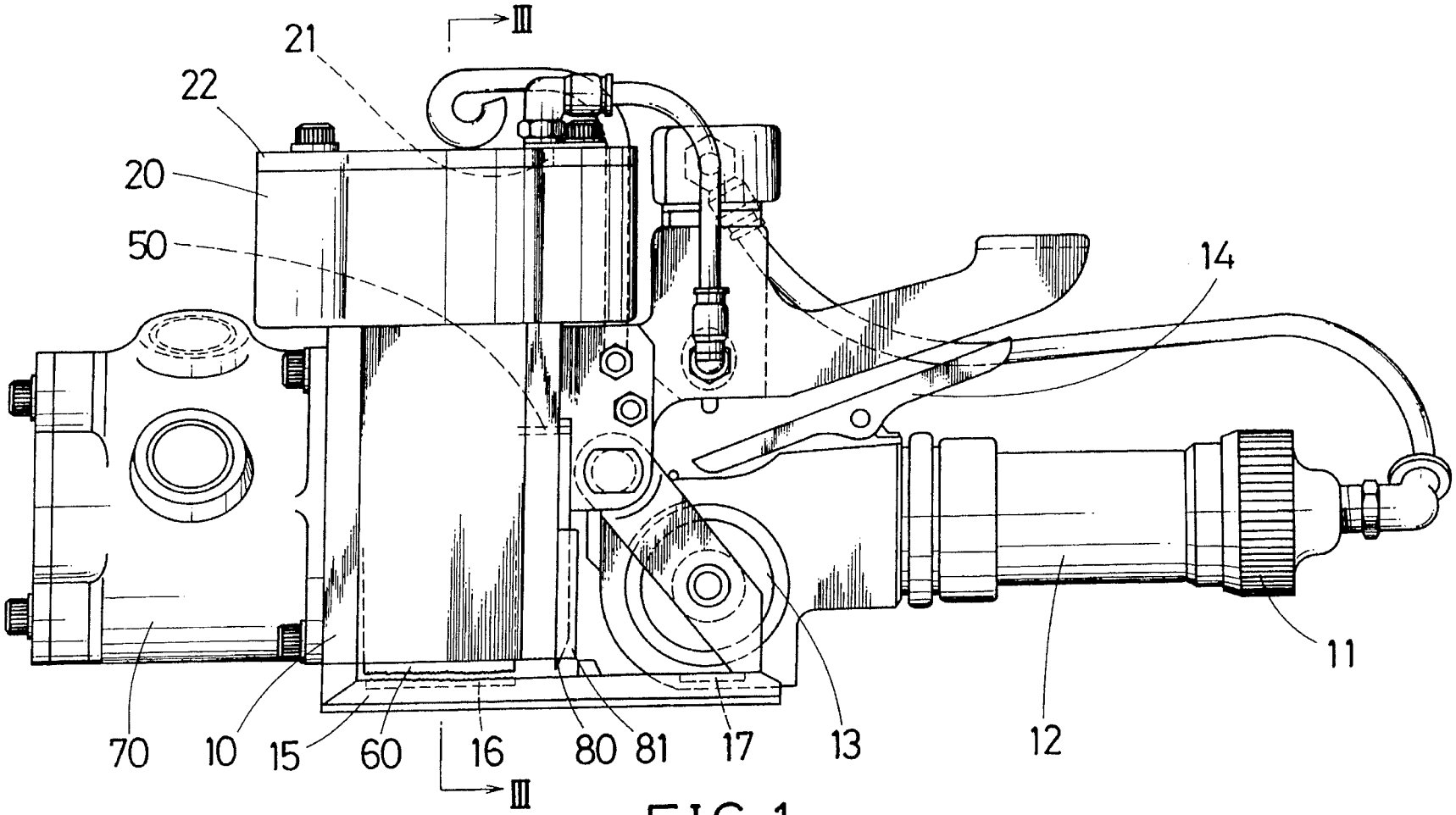
FIG. 1 is a side view showing an embodiment of a binding tool of friction welding type for a thermoplastic strap according to the invention.

An example 1 is shown in FIGS. 1 to 4. In this embodiment, a pressure cylinder 20 for lowering and applying pressure to a vibrator 60 is provided in an upper part of housing 10, a vibrating motor 70 in a front part, arid a strap tightening device 13 having a tightening motor 12 that is operated by a rotational tightening valve 11 in a rear part thereof. Although an electric motor may be used for the tightening motor 12 and vibrating motor 70, an air motor sharing an air source with the pressure cylinder 20 is provided in the embodiment. The pressure cylinder 20 and vibrating motor 70 are operated by a pressurization and vibration lever 14.

Figure 2:
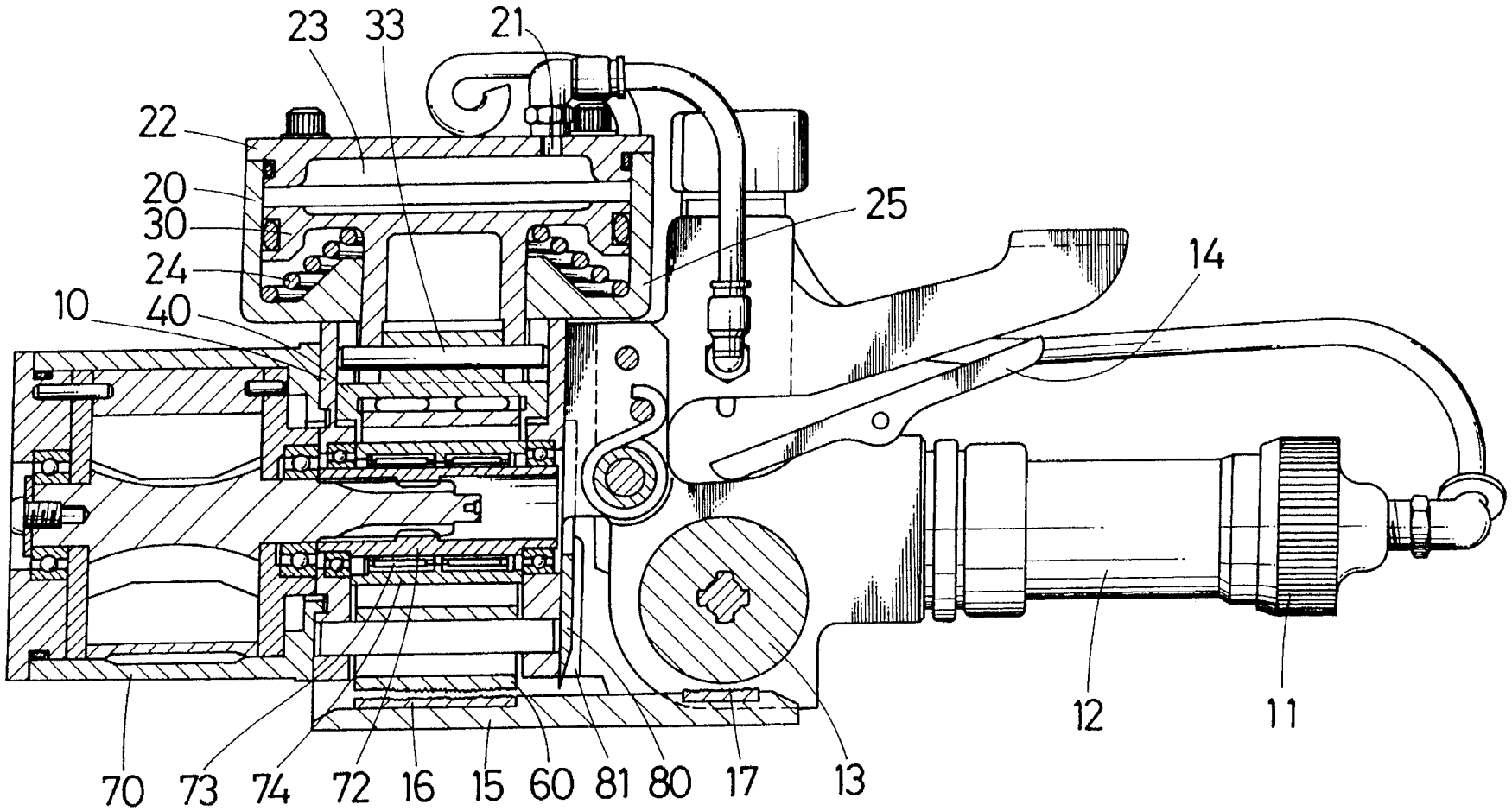
FIG. 2 is a partially cut-away side view of FIG. 1.
Figure 3:
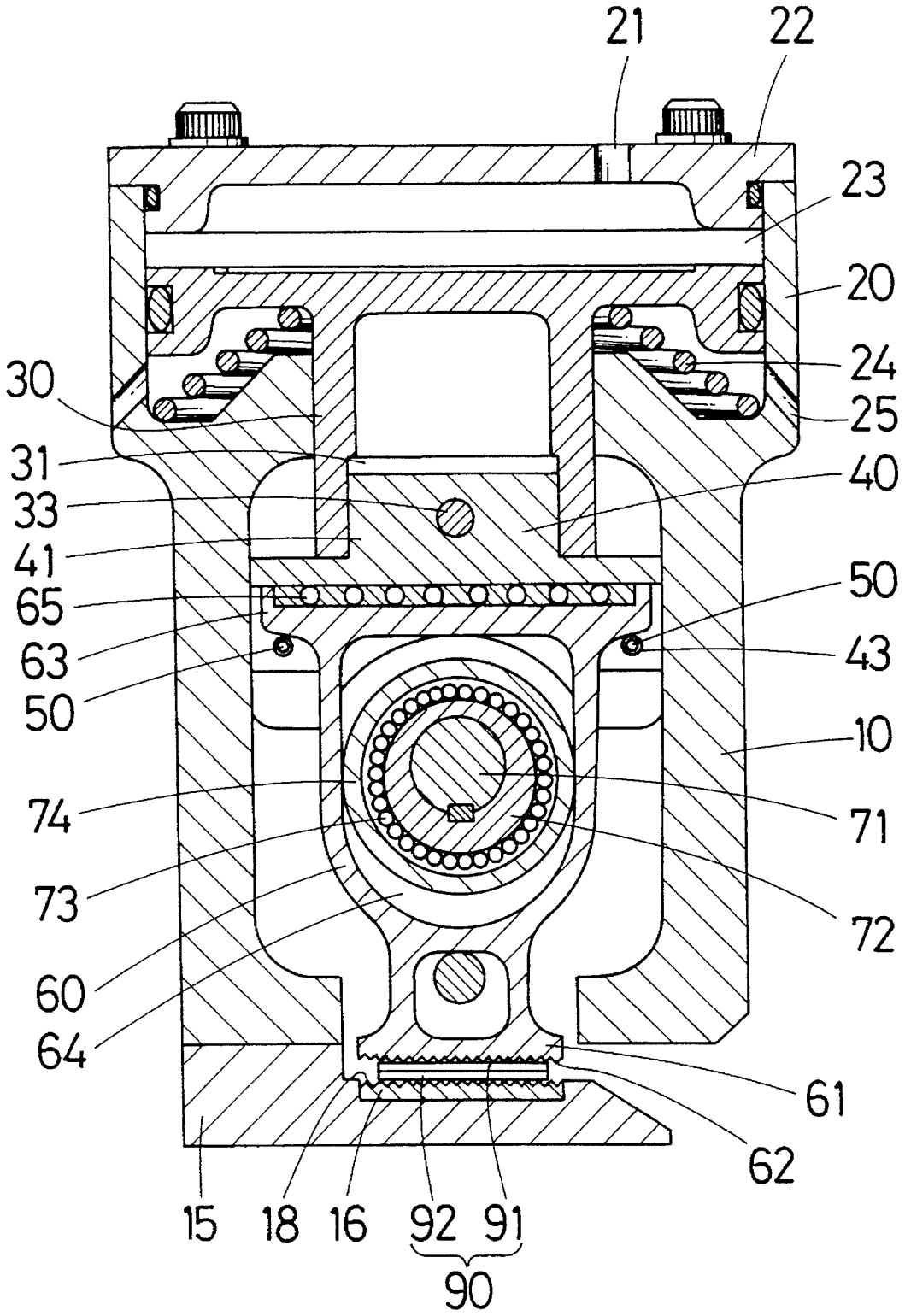
FIG. 3 is a sectional view along a line III—III of FIG. 1.

As shown in FIG. 3, the pressure cylinder 20 has a cylinder cover 22 placed and sealed over it with an air inlet and outlet hole 21 pierced through an upper part thereof so as to form an air chamber 23, and a lifting force for a piston 30 is applied by providing an air inlet and outlet hole 25 through an intermediate part and a spring 24 between a bottom part of the cylinder and the piston 30. A lower part thereof is open, and a base plate 15 is mounted to one of its legs. Lower gripper 16 is placed in the base plate 15 oppositely to a leading end 61 of vibrator in order to fix a lower strap 92 of overlapped strap part 90 in the direction of width and longitudinal, and an anvil 17 is attached thereto for gripping ends of the strap (FIGS. 1 and 2 ).

The piston 30 is inserted through the pressure cylinder 20, and a needle holder 40 connected by a joint pin 33 is provided in a lower part of the piston. Connection of the needle holder 40 with the piston 30 is achieved by forming an engagement projection 41 in an upper part of the piston 40, as shown in FIG. 4, and a joint pin hole 42 through a side surface of the engagement projection 41, while providing an engagement hole 31 through the lower part of piston 30 and a joint pin hole 32 in a circumferential side surface of the engagement hole 31, then, fitting the engagement projection 41 in the engagement hole 31, and inserting the joint pin 33 through both joint pin holes 32 and 42.

Figure 4:
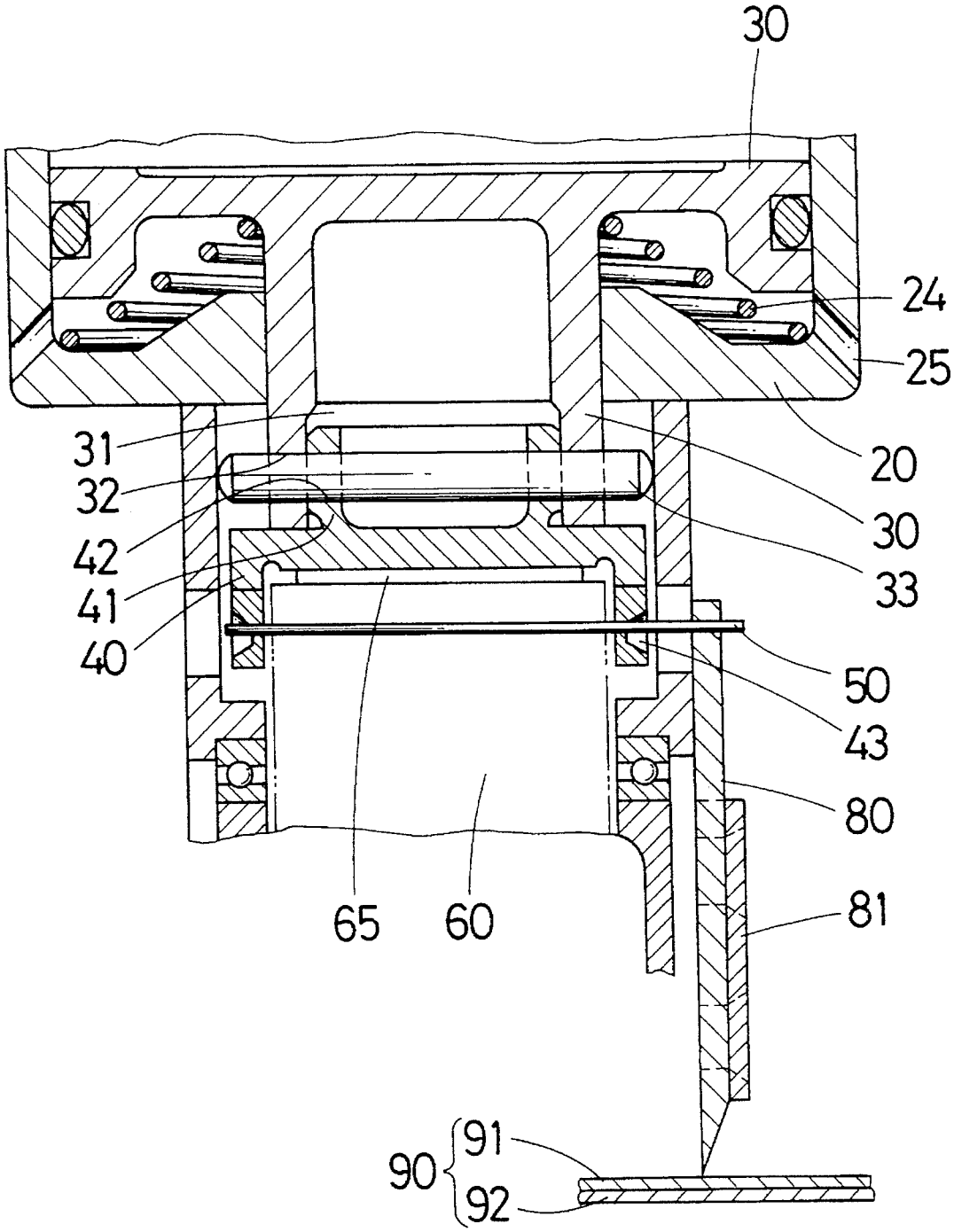
FIG. 4 is a sectional view along a line IV—IV of FIG. 3.

In a lower part of needle holder 40, two side walls are provided hanging down therefrom mutually faced to the other, as observed in FIG. 4, and two elastic members 50 spaced with each other are suspended between the mutually facing side walls. Reference numeral 43 shows holding holes for holding both ends of the elastic member 50, and two for each elastic member, therefore, four holes in total are pierced. It is preferred to provide a clearance in the holding hole 43 for an appropriate escape of the elastic member 50, considering a flexible bending thereof.

In FIG. 3, a vibrator placed in the lower part of needle holder 40 is depicted by reference numeral 60. The vibrator 60 has a flange 63 in an upper part thereof, an upper part of the flange is abutted to a lower part of the needle holder 40, so that the vibrator 60 is lowered as it is pressed directly by the needle holder 40 or through a roller 65 hereinafter described, and a lower part of the flange 63 is engaged with the elastic member 50 for lifting the vibrator 60.

In a central part of the vibrator 60, a hollow part 64 that is arranged to be a vertical slot is formed, and a motor shaft 71, eccentric shaft 72, bearing 73 and hollow roller 74 are housed in the hollow part 64. The eccentric shaft 72 pivoted to the motor shaft 71 is rotated by rotation of an vibrating motor 70, and the upper part of flange 63 of the vibrator 60 is slid in the lower part of needle holder 40, while the vibrator is horizontally vibrated in parallel with the direction of width of an overlapped strap part 90, when the rotation of eccentric shaft 72 is transmitted through the bearing 73 and hollow roller 74 to the vibrator 60. Then, an upper strap 91 of the overlapped strap part 90 that is clamped between a leading end 61 of the vibrator 60 in horizontal vibration and the lower gripper 16 is frictionally welded, as it is vibrated at a high speed in the direction of the width against a lower strap 92 under a pressure by the leading end 61 of vibrator. As shown in FIG. 3, in order to assure transmission of the vibration to the overlapped strap part 90 by vibrator 60, preferably, a roller 65 is provided between a concave part in the upper part of flange 63 of the vibrator and the lower part of needle holder 40 for smooth horizontal movement of the vibrator 60, or projections 62, 18 are formed for preventing slippage in the leading end 61 of vibrator and the lower gripper 16, respectively. Although the projections 62, 18 for prevention of slippage are formed in a saw-tooth shape in the embodiment, they may have a conical, rectangular or triangular pyramidal shape or the like.

As shown in FIG. 4, a cutting blade is indicated by reference numeral 80, and the cutting blade 80 is attached to one end of an elastic member 50 that is held by the needle holder 40. The cutting blade 80 is slidably supported by a support member 81 against the housing 10, and elastically moved in vertical direction according to the elastic member 50 which is vertically moved by the needle holder. Then, in order to cut off a succeeding excess part of the upper strap 91 by utilizing the vibration of upper strap 91 of the overlapped strap part 90 caused by the vibrator 60, an appropriate pressure of such level that the upper strap 91 cannot be cut only with the pressure is applied to the cutting blade by the elastic member 50. It is efficient to cut off the succeeding excess part of upper strap 91 by such cutting blade 80 in combination with the horizontal vibration of upper strap 91 of the overlapped strap part 90 caused by the vibrator 60.

In other words, although the cutting blade 80 is abutted to the succeeding excess part of upper strap 91 of the overlapped strap part 91, as the needle holder 40 holding the elastic member 50 is lowered, because the pressing force of needle holder 40 is transmitted to the cutting blade 80 through the elastic member 50, the cutting blade 80 is applied to the upper strap 91 with a pressure insufficient to cut the strap by itself. When the upper strap 91 of overlapped strap part 90 is finely vibrated in the direction of width at a high speed by the vibrator under such pressure, the cutting blade 80 provides a significant effect, and therefore the upper strap 91 can be serially cut without moving the cutting blade 80, and completely cut off before friction welding of the overlapped strap part 90 is finally achieved. Then, even when the cutting blade 80 is abutted to the lower strap 92 of overlapped strap part 90, as the lower strap 92 is fixed, it cannot be cut off. After the cutting is completed, and the needle holder 40 is lifted by the piston 30, the cutting blade 80 is lifted together with the elastic member 50, and the vibrator 60 is lifted simultaneously with the elastic member 50, as already described.

As the elastic member 50, a spring rod is employed in the embodiment. Also, although the shape of cutting blade 80 may be of a linear flat blade, a saw-tooth blade is preferred for a higher cutting efficiency.

EXAMPLE 2

Figure 5:
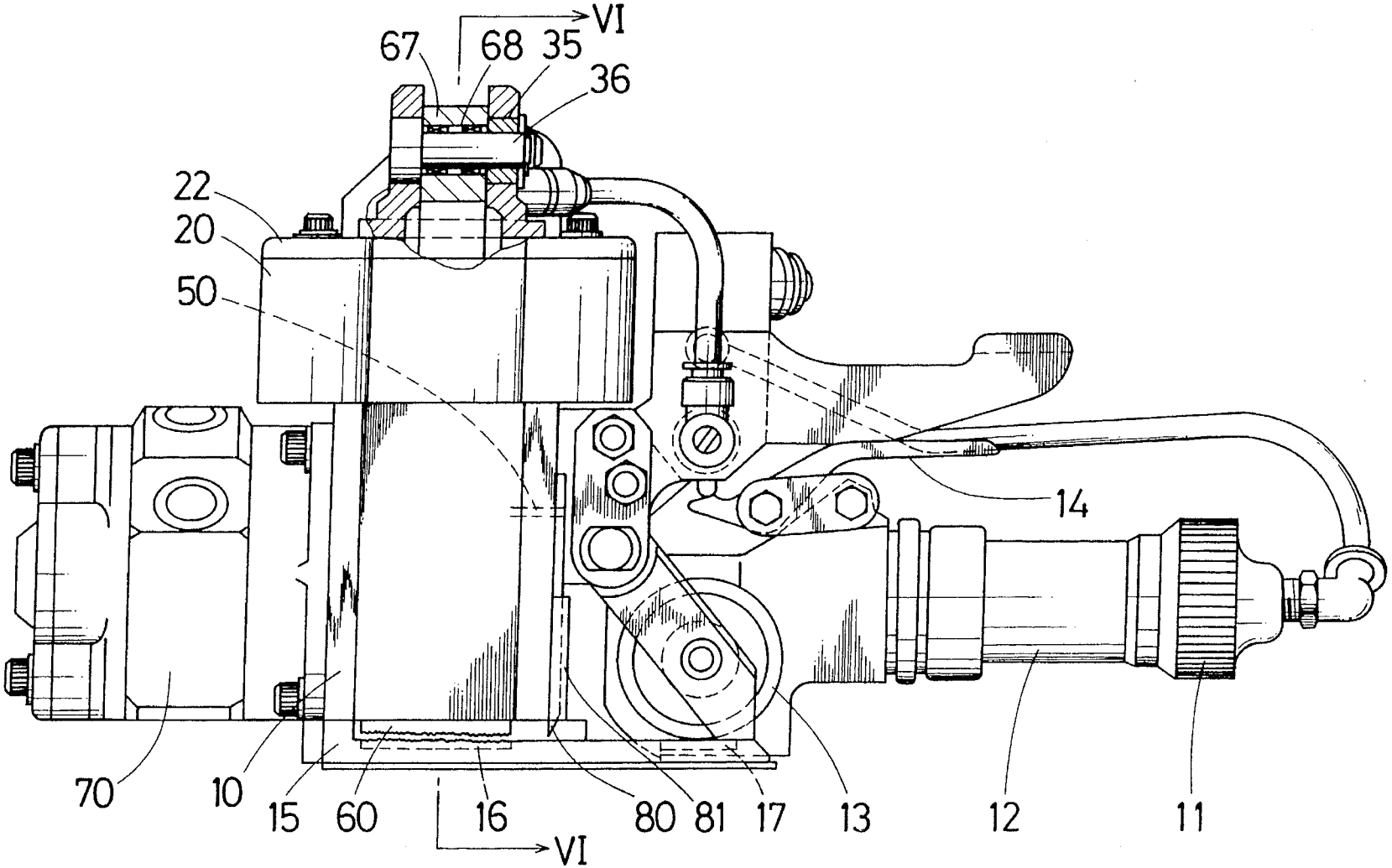
FIG. 5 is a partially cut-away side view of another embodiment of a binding tool of friction welding type for a thermoplastic strap according-to the invention.
Figure 6:
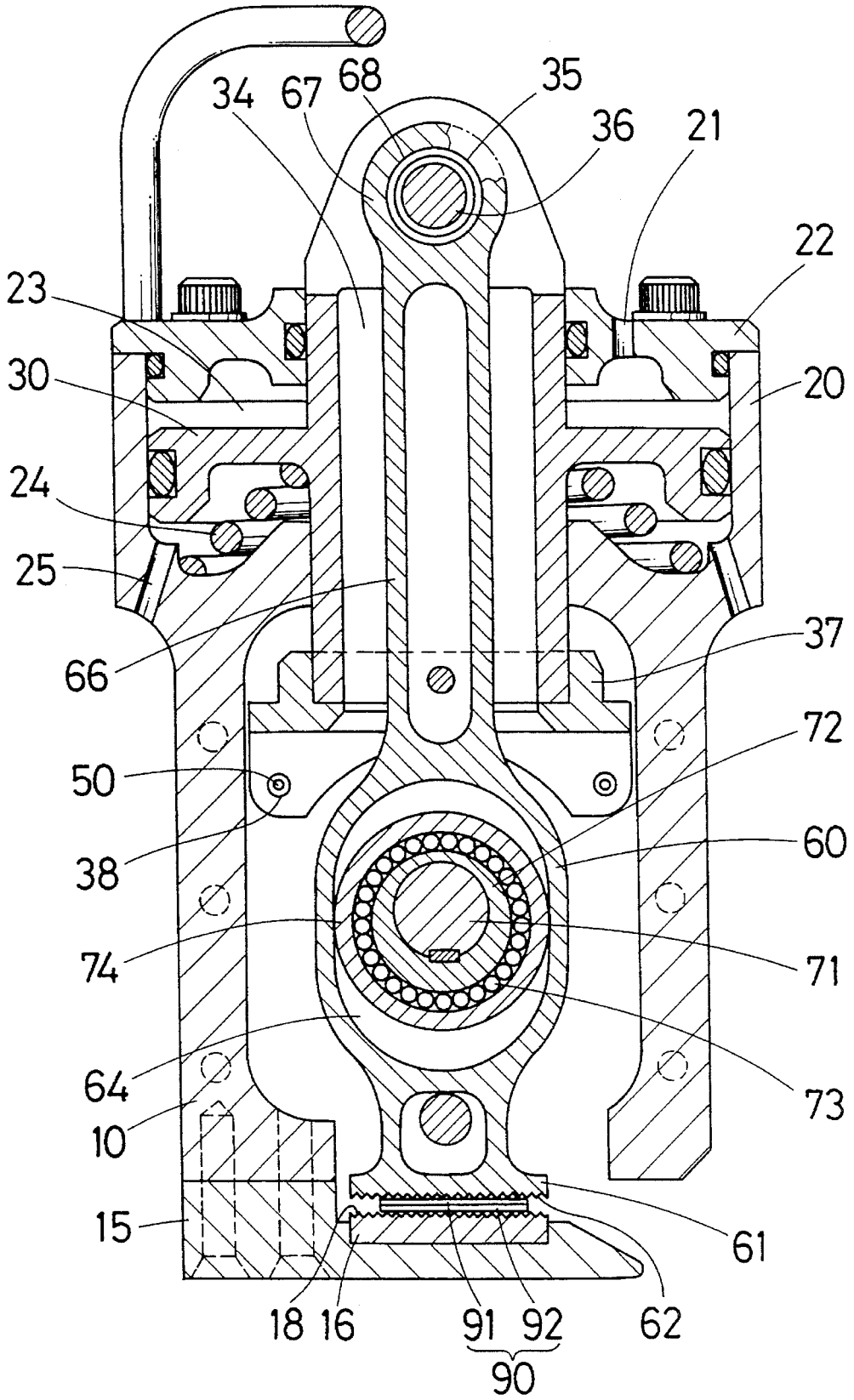
FIG. 6 is a sectional view along a line VI—VI of FIG. 5.

Another embodiment is described by referring to FIGS. 5 and 6. Components identical to those of the example 1 are shown by same reference numerals. The embodiment is different from the example 1 only in that arcuate vibration track of a leading end 61 of vibrator is as close to the horizontal as possible by extending an arm 66 of the vibrator 60 into a hollow 34 of a piston 30, although the vibrator 60 is of a pendulum type connected to the piston in the embodiment, while the entire vibrator 60 is horizontally vibrated by avoiding direct connection of the vibrator to the piston 30 in the example 1, as described above.

In other words, as shown in FIG. 6, a piston 30 inserted through a pressure cylinder 20 has a hollow 34 pierced therethrough, an arm 66 of an vibrator 60 is housed in the hollow 34, and a support axis 67 formed in an upper part of the vibrator 60 is pivoted by a support shaft 36 in an upper part of the piston 30. Therefore, the vibrator 60 is constructed as a pendulum type with a long arm centered about the support axis 67, and a leading end 61 of the vibrator is vibrated along an arcuate track closer to the horizontal, although it is vibrated arcuately about a center in the support axis 67, since the vibrating diameter is relatively large.

The pressure cylinder 20 has a cylinder cover 22 placed and sealed over it with an air inlet and outlet hole 21 pierced through an upper part thereof so as to form an air chamber 23 for vertical movement of the vibrator 60 that is pivoted to the piston 30, and a lifting force for a piston 30 is applied by providing an air inlet and outlet hole 25 through an intermediate part and a spring 24 between a bottom part of the cylinder and the piston 30.

An vibrator mounting hole 35 is provided through the piston 30 in an upper part thereof, an arm 66 of the vibrator 60 is housed in the hollow 34, as already described, and a support shaft 36 is inserted and pivotally mounted to the shaft hole 68 of support axis 67 of the vibrator 60 and the vibrator mounting hole 35. In an embodiment shown in FIG. 6, although the upper part of piston 30 is projected above the cylinder cover 22 of pressure cylinder 20, the piston 30 may be limited in length so that the upper part of piston 30 will not project above the cylinder cover, and the support axis 67 of vibrator 60 may be pivoted within the length.

Additionally, a bottom piston cover 37 is attached to a lower part of the piston 30, and a holding hole 38 is provided through the bottom piston cover 37. Similarly to the example 1, an elastic member 50 is held in the holding hole 38, and a cutting blade 80 is elastically moved in the vertical direction by means of the elastic member 50, so that a succeeding excess part of upper strap 91 can be cut off by utilizing vibration of the upper strap 91 of overlapped strap part 90. As in the example 1, it is efficient to cut off the succeeding excess part of upper strap 91 by such cutting blade 80 in combination with the approximately horizontal vibration of upper strap 91 of the overlapped strap part 90 caused by the vibrator 60.

The support axis 67 is formed in such manner in the upper part of vibrator 60, a hollow 64 that provides a vertical slot in the lower part thereof, and a motor shaft 71, eccentric shaft 72, bearing 73 and hollow roller 74 are housed, as in the example 1, in the hollow 64, so that the vibrator 60 is vibrated in the direction of width of the overlapped strap part 90 about a center in a support shaft 36 by means of rotation of an vibrating motor 70.

For prevention of slippage, projections 62, 18 may be formed, respectively, in the vibrator at a leading end 61 thereof and a lower gripper 16 positioned against the leading end 61 of vibrator. Moreover, in order to assure transmission of the vibration by vibrator 60 to the overlapped strap 90, preferably, a surface of the projection 62 at the leading end 61 of vibrator is formed in a moderately convexed arcuate surface centered about the support shaft 36 to the vibrating direction of the vibrator 60, while a surface of the projection 18 in the lower gripper 16 is formed, corresponding to the surface of projection 62 at leading end 61 of the vibrator, in a concave arcuate surface along the vibrating direction with a diameter being a distance to the support shaft 36 including a thickness of the overlapped strap part 90 of thermoplastic strap that is clamped between them. Although the leading end 61 of vibrator shown in the embodiment is integral with the vibrator 60 directly placed, the leading end 61 may be fabricated and mounted as a separate unit, or an vibrating flat type prepared as a separate unit may be pivotally mounted. Also, although the projections 62, for prevention of slippage is formed in a saw-tooth shape in the embodiment, they may have a conical, rectangular or triangular pyramidal shape or the like. When the surface of projection 62 at the leading end 61 of vibrator is flat, the surface of projection 18 in the lower gripper 16 should be also flat.

Succeedingly, operations of the examples 1 and 2 are described.

First of all, a leading end of thermoplastic strap wound about an object to be bound is gripped, while the succeeding part is inserted to the strap tightening device 13 and the overlapped strap part 90 is placed on the lower gripper 16.

Then, by rotating a rotational tightening valve 11 of the strap tightening device 13, the tightening motor 12 is rotated, and the thermoplastic strap wound about the object is rigidly tightened.

Now, by pressing the lever 14 for pressurization and vibration, while releasing the rotational tightening valve 11 and maintaining a stalling tension, compressed air is fed from the air inlet and outlet hole 25 into the air chamber 23 of pressure cylinder 20, and the piston 30 is pressed downward against a force of the spring 24. When the piston 30 is pressed downward, the vibrator 60 is lowered by the support shaft 36 in FIG. 5, or the needle holder 40 in FIG. 1, thus, the leading end 61 of vibrator applies a strong pressure to the overlapped strap part 90 rested on the lower gripper 16. At the same time, the vibrating motor 70 is activated for rotation, vibration is effected in the hollow part 64 of vibrator by operations of the motor shaft 71, eccentric shaft 72, bearing 73 and hollow roller 74, and the vibrator 60 is vibrated at a high speed in the direction of width of the overlapped strap part 90.

Since the lower strap 92 of overlapped strap part 90 is fixed to the lower gripper 16, only the upper strap 91 is vibrated in the direction of width, and the contact surfaces of the overlapped strap part 90 is frictionally welded by the frictional heat.

Then, by releasing the lever 14 for pressurization and vibration after an appropriate time, supply of air is discontinued, the air in the air chamber 23 is emitted from the air inlet and outlet hole 21, the piston 30 is lifted by a restorative force of the spring 24, and the vibrating motor 70 is stopped at the same time.

When the piston 30 is lowered, and the upper strap 91 of overlapped strap part 90 is vibrated, the cutting blade 80 cuts off the succeeding excess part of upper strap 91 by the effect of elastic member 50 that is attached to the bottom piston cover 37 in FIG. 6, or needle holder 40 in FIG. 1.

What is claimed is:

1. A binding tool of friction welding type for a thermoplastic strap that tightens the thermoplastic strap wound and overlapped about an object, and frictionally welds it by vibrating an upper strap, while applying pressure to an overlapped part of the strap in that state, comprising:

means for tightening the thermoplastic strap, housing means provided adjacent to the tightening means, lower strap pressure support means provided below the housing means for fixing and supporting the lower strap, upper strap vibrating means provided in the housing means for vibrating an upper strap laid over the lower strap that is fixed on the lower strap pressure support means, driving means for driving the upper strap vibrating means, and vibrating the same at a high speed, pressure means provided directly above the upper strap vibrating means in the housing means for lowering and pressing the upper strap vibrating means against the lower strap pressure support means, lifting means for lifting the pressure means and the upper strap vibrating means after friction welding of both upper and lower straps is completed;

wherein the housing means is provided with a cylinder means having a port means in an upper part thereof, the pressure means comprises the cylinder means, piston means slid in the cylinder means by pressure of a fluid that is fed into or emitted from the cylinder means through the port means, and holder means connected to the piston means at a lower end thereof, and having a lower surface formed in a flat surface, the upper strap vibrating means is provided for horizontal vibration, and having flanges in both edges at an upper end thereof, respectively, and the lifting means is provided in the cylinder means, and comprises forcing means forcing the piston means upward, when the fluid is emitted from the cylinder means through the port means, and a pair of elastic means placed in the holder means so as to support a flange part of the upper strap vibrating means from a lower surface side thereof, the holder means is lifted as the piston means is forced upward by the forcing means, and the upper strap vibrating means is lifted accordingly by the elastic means.

2. A binding tool of friction welding type for a thermoplastic strap according to claim 1, wherein the binding tool further comprises cutting means that comes in contact with the upper strap vibrated at a high speed by the upper strap vibrating means in the rear side of the overlapped part frictionally welded, and cuts only the upper strap for separating the succeeding excess part of upper strap from the overlapped part, said cutting means being provided slidably in the direction identical to the pressing direction of the pressure means in the outside of the housing means, and one end of the elastic means is drawn out of the housing means, and connected to the cutting means, and the pressure of elastic means is set at such appropriate level that the upper strap cannot be cut only with the pressure.

3. A binding tool of friction welding type for a thermoplastic strap according to claim 1, wherein the upper strap vibrating means has a concave part in a lower surface of the holder means and an upper surface facing thereto, and sliding means for reducing frictional force caused between the upper strap vibrating means and the holder means during vibration of the upper strap vibrating means is provided in the concave part.

4. A binding tool of friction welding type for a thermoplastic strap according to claim 2, wherein the upper strap vibrating means has a concave part in a lower surface of the holder means and an upper surface facing thereto, and sliding means for reducing frictional force caused between the upper strap vibrating means and the holder means during vibration of the upper strap vibrating means is provided in the concave part.

5. A binding tool of friction welding type for a thermoplastic strap according to claim 3, wherein the sliding means is a roller.

6. A binding tool of friction welding type for a thermoplastic strap according to claim 4, wherein the sliding means is a roller.

7. A binding tool of friction welding type for a thermoplastic strap according to claim 1, wherein the elastic means is a spring rod.

8. A binding tool of friction welding type for a thermoplastic strap according to claim 2, wherein the elastic means is a spring rod.

9. A binding tool of friction welding type for a thermoplastic strap according to claim 2, wherein the cutting means is a cutting blade having a blade shape of saw-tooth.

10. A binding tool of friction welding type for a thermoplastic strap, that tightens the thermoplastic strap wound and overlapped about an object, and frictionally welds it by vibrating an upper strap, while applying pressure to an overlapped part of the strap in that state, comprising:

means for tightening the thermoplastic strap, housing means provided adjacent to the tightening means, lower strap pressure support means provided below the housing means for fixing and supporting the lower strap, upper strap vibrating means provided in the housing means for vibrating an upper strap laid over the lower strap that is fixed on the lower strap pressure support mean, driving means for driving the upper strap vibrating means, and vibrating the same at a high speed, pressure means provided directly above the upper strap vibrating means in the housing means for lowering and pressing the upper strap vibrating means against the lower strap pressure support means, lifting means for lifting the pressure means and the upper strap vibrating means after friction welding of both upper and lower straps is completed;

wherein the housing means is provided with a cylinder means having port means in an upper part thereof, the pressure means comprises the cylinder means, and hollow piston means slid in the cylinder means by pressure of a fluid that is fed into or emitted from the cylinder means through the port means, the upper strap vibrating means is inserted in an upper part thereof through the piston means, its upper end is pivotally mounted to an upper end of the piston means, thereby provided for vibration of a pendulum type about a center in the pivot means, the lifting means is provided in the cylinder means, and comprises a forcing means forcing the piston means upward, when the fluid is emitted from the cylinder means through the port means.

11. A binding tool of friction welding type for a thermoplastic strap according to claim 10, wherein the piston means is projected in its upper end above an upper end of the cylinder means.

12. A binding tool of friction welding type for a thermoplastic strap according to claim 10, wherein the binding tool further comprises cutting means that comes in contact with the upper strap vibrated at a high speed by the upper strap vibrating means in the rear side of the overlapped part frictionally welded, and cuts only the upper strap for separating the succeeding excess part of upper strap from the overlapped part, and an elastic means connected to the cutting means for supporting the cutting, means, the cutting means being provided slidably in the direction identical to the pressing direction of the pressure means in the outside of the housing means, and the elastic means is provided at a lower end of the piston means, one end thereof is drawn out of the housing means, and connected to the cutting means, and the pressure of elastic means is set at such appropriate level that the upper strap cannot be cut only with the pressure.

13. A binding tool of friction welding type for a thermoplastic strap according to claim 10, wherein the upper strap vibrating means is formed in its contact surface with the upper strap in a moderately convexed arcuate surface centered about the pivot means, and the lower strap pressure support means is formed in a concave arcuate surface corresponding to the convex arcuate surface.

14. A binding tool of friction welding type for a thermoplastic strap according to claim 12, wherein the elastic means is a spring rod.

15. A binding tool of friction welding type for a thermoplastic strap according to claim 12, wherein the cutting means is a cutting blade having a blade shape of saw-tooth.

16. A binding tool of friction welding type for a thermoplastic strap according to claim 10, wherein a hollow part is formed in the upper strap vibrating means, and t he driving means is connected to the hollow part.

17. A binding tool of friction welding type for a thermoplastic strap according to claim 16, wherein the driving means includes a hollow roller inserted through the hollow part of upper strap vibrating means so as to be in contact with an inner wall thereof, an eccentric shaft inserted inside the hollow roller through a bearing, a driving shaft inserted in the eccentric shaft and a driving source provided outside the housing means for rotatably drive the driving shaft.

18. A binding tool of friction welding type for a thermoplastic strap according to claim 10, wherein the lower strap pressure support means is further formed with a projection for preventing slippage of the lower strap.

* * * * *